US005272823A

United States Patent [19]

Perrissoud

[11] Patent Number: 5,272,823

[45] Date of Patent: Dec. 28, 1993

[54] SKI BOOT WITH PIVOTING FRONT CUFF

[75] Inventor: Claude Perrissoud, Saint Jorioz, France

[73] Assignee: Salomon S.A., Annecy Cedex, France

[21] Appl. No.: 767,417

[22] Filed: Sep. 30, 1991

[30] Foreign Application Priority Data

Oct. 2, 1990 [FR] France ..... 90 12340

[51] Int. Cl.[5] ..... A43B 5/04

[52] U.S. Cl. ..... 36/119; 36/118; 36/54

[58] Field of Search ..... 36/117-121, 36/50, 54, 88, 109, 93

[56] References Cited

U.S. PATENT DOCUMENTS

| | | | |
|---|---|---|---|
| 4,825,566 | 5/1989 | Sartor | 36/119 |
| 4,882,857 | 11/1989 | Sartor et al. | 36/120 |
| 4,918,842 | 4/1990 | Lederer | 36/120 |
| 4,934,074 | 6/1990 | Sartor | 36/117 |
| 4,944,100 | 7/1990 | Sartor et al. | 36/120 |
| 5,031,340 | 7/1991 | Hilgrath | 36/117 |

FOREIGN PATENT DOCUMENTS

| | | | |
|---|---|---|---|
| 053340 | 6/1982 | European Pat. Off. | 36/117 |
| 123636 | 10/1984 | European Pat. Off. | 36/120 |
| 169831 | 1/1986 | European Pat. Off. | 36/119 |
| 0171685 | 2/1986 | European Pat. Off. . | |
| 230981 | 8/1987 | European Pat. Off. | 36/117 |
| 1817970 | 4/1976 | Fed. Rep. of Germany . | |
| 3406591 | 8/1985 | Fed. Rep. of Germany | 36/117 |
| 3429891 | 2/1986 | Fed. Rep. of Germany | 36/119 |
| 2607368 | 6/1988 | France | 36/119 |
| WO8900015 | 1/1989 | World Int. Prop. O. . | |

*Primary Examiner*—Steven N. Meyers
*Assistant Examiner*—Thomas P. Hilliard
*Attorney, Agent, or Firm*—Sandler, Greenblum & Bernstein

[57] ABSTRACT

A ski boot with a rigid shell base having an upper at least partially journalled on the shell base, the upper being provided with a rear spoiler and a front cuff. The front cuff pivots on the end of the shell base and is capable of a vertical displacement when the upper is open. This displacement is permitted by the linkage apparatus which determines its amplitude and which constitutes the linkage and the low reference abutment of the front cuff, especially when the latter closes the slot of introduction of the foot in the boot under the action of the internal foot retention apparatus to which it is associated.

23 Claims, 5 Drawing Sheets

FIG : 4
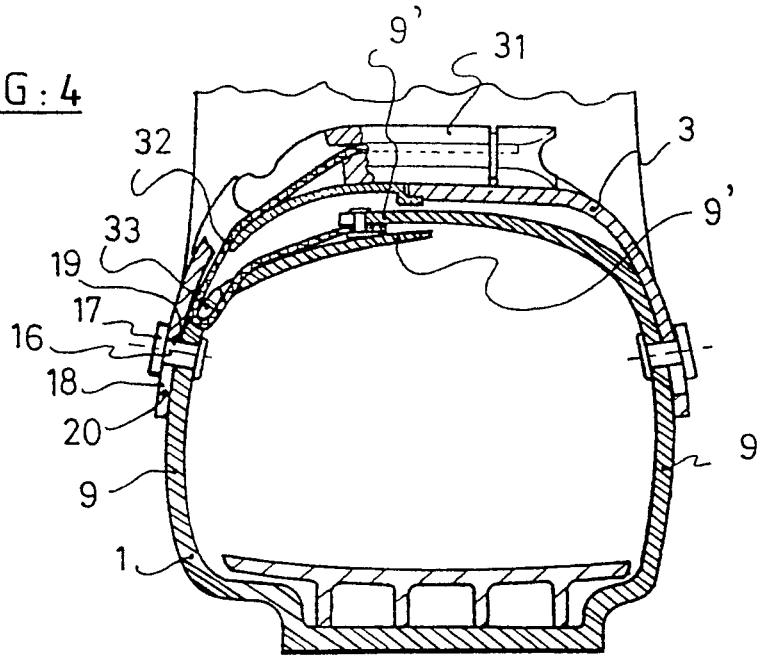
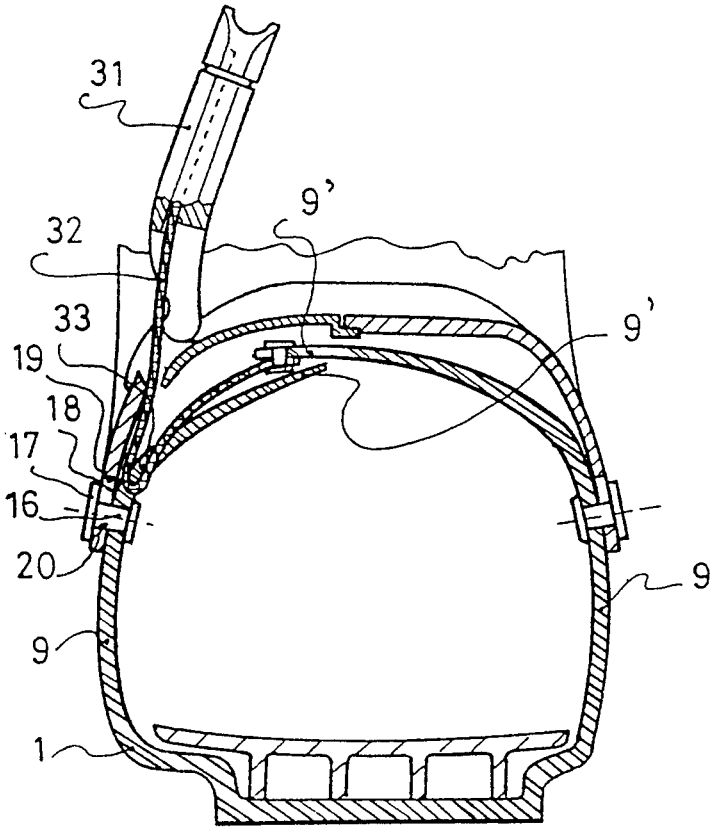
FIG : 3

SKI BOOT WITH PIVOTING FRONT CUFF

BACKGROUND OF THE INVENTION

1. Field of the Invention

The present invention relates to a ski boot with a rigid shell, whose upper, at least partially journalled around a shell base, is constituted on the one hand, of a collar made of at least one pivoting portion on the shell base and, on the other hand, of the rear end of a foot-covering spoiler which closes the front opening of the shell base after insertion of the foot into the boot so as to ensure good retention of the foot and the front portion of the lower part of the leg.

2. Description of Background and Relevant Information

Known ski structures of the aforementioned type must fulfill different obligations. They need especially to use rigid materials for the manufacture of their shell so as to be able to instantly transmit the impulsions of the foot of the skier, thereby allowing precise control of the skis during skiing. To this end, the foot and the heel are generally tightly held in the boot by adjustable portions more or less flexible and/or anatomical, and are protected from all damage at the level of their journals by the rigid parts of the shell, journalled between themselves and relatively spaced from the adjustable portions. Such boots also protect the foot from shocks and external shocks, in particular shocks from running edges of the ski.

European Patent Application No. 0171685 shows a ski boot of this type. In this application, a slot extends longitudinally from the upper front end of the shell base to the front edge of the upper where it ends. A pivoting front cuff on the end of the shell base covers the slot and extends as far as the lower part of the leg where it connects with a rear spoiler to ensure the closing of the upper. As taught by this document, the foot retention is done by means of a central locking comprising a traction and linkage element interacting between the tongue and the shell base, such that they get closer to each other. The same central locking also frees them for a certain amount of displacement, a function of the loosened length of the traction element, so as to facilitate the engaging or the retraction of the foot when the upper of the boot is open. As it appears clearly, this possibility of displacement is, thus, without limit well-defined since it depends on the loosening done by virtue of the central locking. Furthermore, since the retention of the boot is a function of the tension exerted by the traction element on the cuff and the shell base and thus, the coming together of the latter with respect to each other, the front cuff is more or less lowered depending on the size of the foot. According to this concept of foot retention, where the front cuff does not have a free abutment, or even the reference in its lowered position on the sides of the shell base from one end to the other of the longitudinal slot which it covers, the front cuff is capable of lowering itself further, after adjusting the position of the foot during skiing, especially during front supports biasing the upper of the boot in flexion. The result is some loosening of the traction element which is detrimental for foot retention and therefore detrimental for a precise control of the skis.

SUMMARY OF THE INVENTION

The present invention proposes a new embodiment of a front cuff adapted to pivot in displacement with respect to the shell base according to an amplitude of a predetermined value when the upper of the boot is open by virtue of a path limiting apparatus, also enabling a connection between the cuff and the shell base.

Another object of the invention is to make a foot retention apparatus in the boot cooperate with the front cuff and its path-limiting apparatus so that, whatever the size of the foot to be held and the tightening force desired, the path-limiting apparatus serves as an abutment and reference element for the adjustment of at least one traction element of the foot retention apparatus.

The ski boot according to the invention is of the type which comprises a rigid shell base on which an upper is at least partially journalled, the upper being provided with a front cuff and a rear spoiler, both pivoting on the shell base, one in the front end zone of the boot, the other in the zone of the heel. The shell base is made of an upper longitudinal slot for introduction of the foot, demarcated by vertical extensions extending from the rigid sole and constituting the walls of the boot which, at the level of the malleoli, in association with the vertical parts of the front and rear spoilers, forms the upper of the boot. In order to facilitate the engagement of the foot, these walls are provided to be relatively deformable and/or flexible so as to adhere closely to the shape of the foot, especially near the edge demarcating the longitudinal slot of the shell base. For the zone corresponding to the front of the foot for example, the lateral walls extend until they are at least partially joined are and/or covered so as to envelope the front of the foot.

According to the invention, the front cuff covers the entire upper front part of the shell base, especially its slot and its edge, from the end of the boot where it is pivotally mounted, as far as the level of the upper, and permits a certain upward displacement, when the upper is open, in order to facilitate the introduction and/or the disengagement of the foot from the boot, by means of a path-limiting apparatus. To this effect, on the one hand, the front cuff is provided as a single piece in the shape of a curved member overlapping the slot of the shell base and presenting a lower front portion whose wings partially cover the walls of the shell base, in the zone of the front foot. On the other hand, the wings of the spoiler or cuff are connected to the walls of the shell base, each, by a linkage comprising an axis with a retention head cooperating with an oblong slot which is substantially concentric at the pivoting point of the cuff at the end of the boot. Therefore, the front cuff is adapted to pivot in displacement only within the limits permitted by the length of the oblong slot which intrinsically determines the extreme positions that the cuff can assume with respect to the shell base, i.e., upwardly, when one desires to disengage the introduction slot of the foot and downwardly, when, on the contrary, one wishes to close the slot so as to ensure the foot retention in the boot and/or the impermeability of the latter.

Accordingly to an embodiment of the linkage apparatus, the oblong slot is obtained in the lateral extension of the front cuff, whereas the axis is obtained from the wall of the shell base, and comprises the retention head adapted to prevent any spacing of the corresponding extension with respect to the shell base.

According to another embodiment of the linkage apparatus, the oblong slot is obtained in the wall of the shell base, whereas the axis of the linkage apparatus is carried by the lateral extension of the front spoiler and comprises the retention head preventing any relative spacing of the extension with respect to the corresponding wall.

According to another characteristic of the invention, the front cuff is provided with at least one control element of a foot retention apparatus interacting between the cuff and the shell base at the level of the edges of the longitudinal slots by way of at least one traction element such as a cable. Preferably, this foot retention apparatus is constituted by a maneuvering element which rests on the front part of the front cuff and a cable which, connected to at least one of the edges of the lateral walls of the shell base demarcating the slot in the zone of the front foot, is connected under tension to the maneuvering element. This cable extends from the edge to which it is connected to the opposite edge which it surrounds partially, to a return located on the corresponding wall of the shell base. From this return, the cable goes upward towards the front portion of the cuff which it crosses by a guiding orifice and is connected to the maneuvering element. Therefore, during tensioning of the cable, the edge to which it is linked is deformed by extension, which decreases the curve of the latter which is applied on top of the foot with more or less pressure, depending on the high or low tension of the cable, and depending on the amount of deformation of its enveloping curve of the foot. Simultaneously, due to the fact that the maneuvering element rests on the front portion of the cuff, the latter comes closest to the shell base up until a lower limit where the oblong slot and the axis with a retention head come into abutment. Advantageously, the relative position of the axis with a retention head and of the oblong slot with respect to the shell base is determined to ensure a relatively tight closing of the top of the boot. As is apparent from the preceding description, the tightening and/or retention of the foot in the boot is thus done preferably when the path-limiting apparatus is brought into an abutment position towards the bottom. This limiting apparatus constitutes, therefore, a low reference abutment for the front cuff, enabling especially to guarantee the precision and constancy of the adjustment of the foot retention apparatus.

According to a preferred embodiment, the front cuff presents two parts that are distinct by virtue of their mechanical properties. The front part, which corresponds to the zone of the front foot is provided to be rigid, whereas the second rear part is flexible. The goal of this differentiation is to ensure, on the one hand, an efficient protection of the front foot under the rigid portion constituting a shield and, on the other hand a possibility of flexion of the upper towards the front when the latter is closed on the lower part of the leg of the skier, that is, when the rear end of the front cuff is linked to the rear spoiler. Likewise, because the front part of the cuff is provided as to be rigid, this characteristic allows the prevention of a deformation or eventual flexion of this part at the level of the resting point of the maneuvering element and/or the path-limiting apparatus, thus contributing to the precision of the adjustment of the foot retention apparatus.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which:

FIGS. 3 and 4 are sectional views according to line III—III of the boot of FIG. 2 and show, respectively, the opening position of the front cuff and the closing position of the front cuff;

DETAILED DESCRIPTION OF THE PREFERRED EMBODIMENTS

Figure 1:
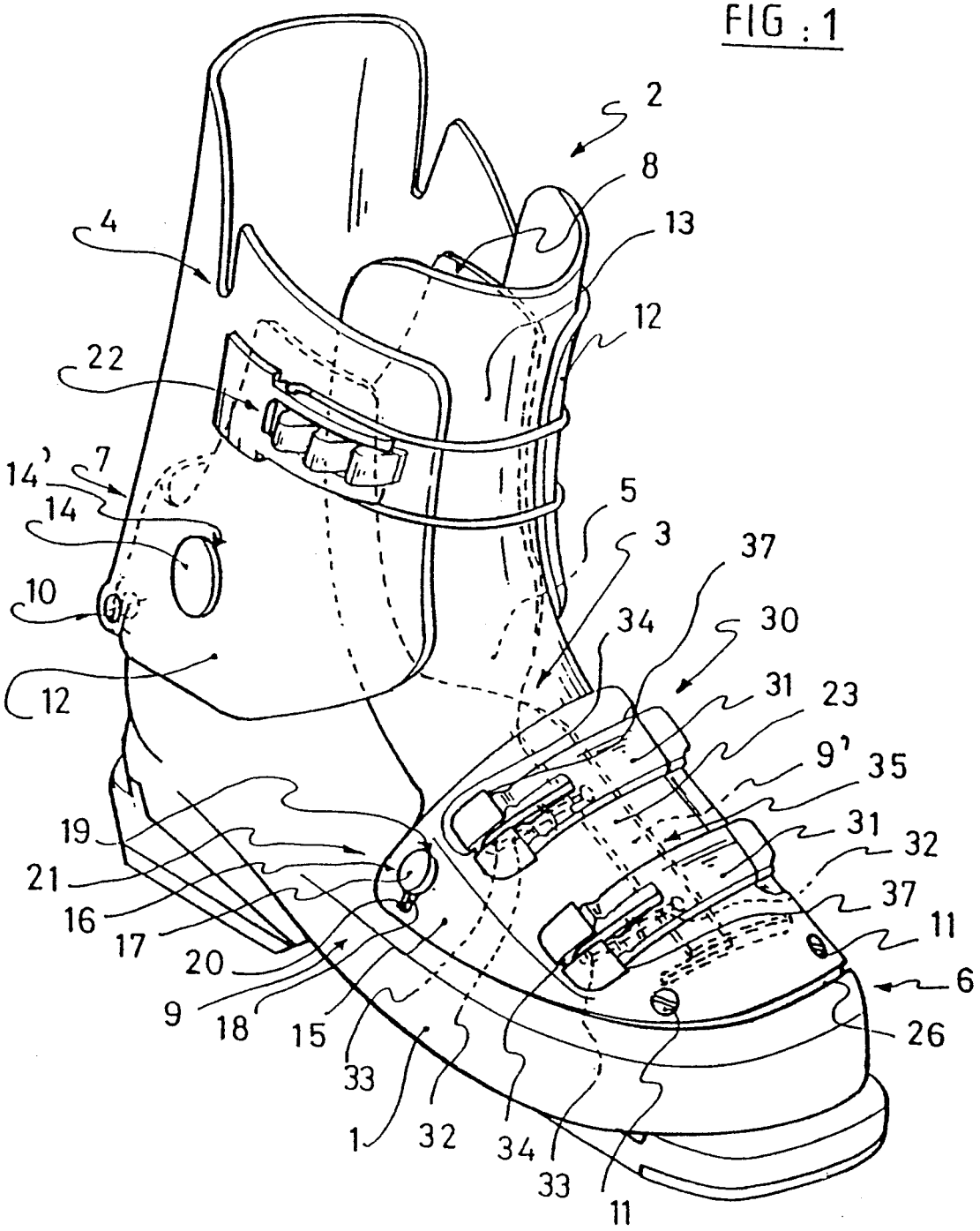
FIG. 1 illustrates, in a perspective view, a ski boot comprising a front cuff according to the invention to which an internal foot retention apparatus is associated.
Figure 2:
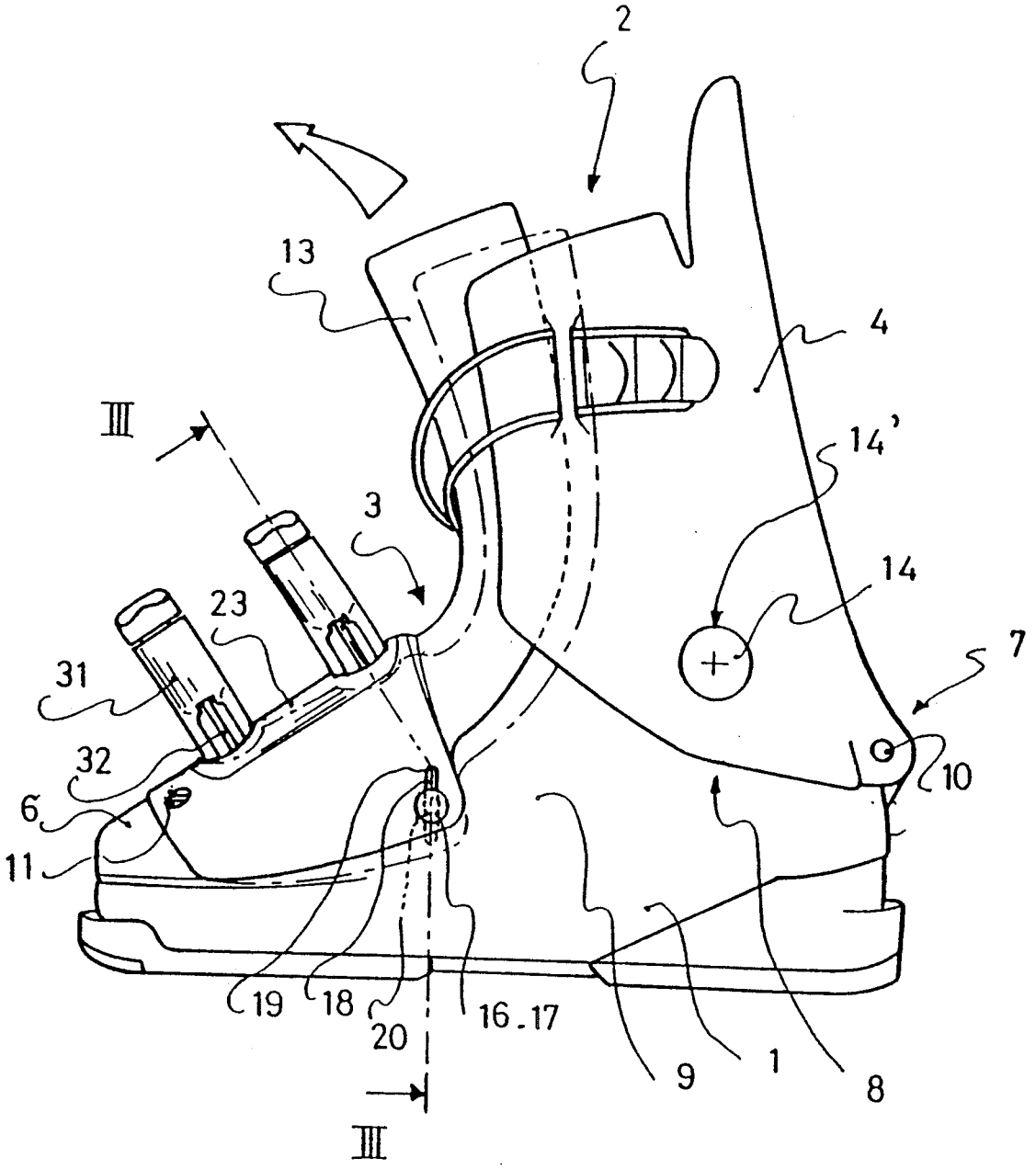
FIG. 2 is an elevational view of the boot of FIG. 1 seen from the inner side and showing the extreme positions that the front cuff can take with respect to the shell base.

The ski boot represented on FIGS. 1–4 comprises a rigid shell base 1 on which an upper 2 is journalled, with a front cuff 3 and rear a spoiler 4. The shell base 1 presents an upper longitudinal slot 5 for introduction of the foot, which extends from the front 6 of the boot to the rear 7. This slot 5 is demarcated, among other things, by vertical extensions 8 in the zone of the malleoli and vertical extensions 9 in the zone of the front of the foot, end portions of the latter ending in the shape of tongues 9' and covering each other at least partially so as to cover the top of the front of the foot.

In this embodiment of the boot, the rear spoiler 4 is pivotal on the shell base 1 in the zone of the heel around a generally horizontal transverse axis 10 and the front cuff 3, around fastening elements 11 located near the front 6 of the boot. Furthermore, the rear spoiler 4 is provided with two lateral wings 12 which surround, on the one hand, the vertical extensions 8 of the shell base 1 on which they are fastened by virtue of holes 14' on projection pins 14 and, on the other hand, at least partially the vertical upper portion 13 of front cuff 3. The rear spoiler 4 thus constitutes, in association with a connection apparatus 22 for wings 12, the closing collar of the upper 2 on the lower part of the leg of the skier. The front cuff 3 is provided as a single piece in the shape of a curved channel, overlapping slot 5 of the shell base 1 by its rear portion 13 on the zone of the lower leg and by its front portion 23 in the zone of the front foot. The latter covers tongues 9' and, at least partially, the vertical extensions 9 which constitute the walls of the shell base 1, approximately in front of the zone of the upper portion of the foot. To this end, the front cuff 3 comprises two lateral extensions 15 which extend towards the bottom of the walls 9. According to the invention, the front cuff 3 is connected to these walls by virtue of the lateral extensions 15 and linkage apparatus 21 comprising an axle or pin 16 with a retention head 17 cooperating with an oblong slot 18. In this embodiment, axle 16 extends from walls 9 of shell base 1, whereas the oblong slot 18 is obtained in the lateral extensions 15 of the front cuff 3.

In order to allow for the vertical displacement of the front cuff 3, the rear spoiler or closing collar 4 of the upper 2 being previously open, the oblong slot 18 is preferably substantially concentric to the fastening elements 11 and extends along a certain predetermined length which determines the amplitude of the displacement. Furthermore, the relative positions of axle 16 and the oblong slot 18 with respect to the shell base and to the front cuff 3, respectively, are fixed by construction at a certain height for which axle 16, on the one hand, is in abutment on the upper end 19 of slot 18 when the cuff 3 is pressed downwardly against the shell base 1 which it closes and, on the other hand, is in abutment on the lower end 20 of the slot 18 when the front cuff 3 is in the raised position. In order to perfect the sealing and/or, the closing, the front part 23 of front cuff 3 is able to move partially into a hollow area 26 made on the front 6 of shell base 1.

Also according to the invention, an internal foot retention apparatus 30 interacting between the shell base 1 and front cuff 3 cooperates with the linkage apparatus 21 of the latter and constitutes the control means by closing and by opening of the cuff simultaneously with the achievement of the foot retention or that of freeing of the element in the boot. This internal foot retention apparatus 30 is constituted by a manipulation element 31, such as a lever, which rests in a housing 37 on the front cuff 3 and one linkage cable 32 from a wall 9 to the other wall 9 of the upper longitudinal slot 5. Advantageously, cable 32 is anchored at the end of one of the tongues 9' which extends the walls 9, partially surrounds the opposite tongue 9' until a return 33 located on the corresponding wall 9 and continues upward to lever 31 through a guiding orifice 34 provided in the front part 23 of front cuff 3. Thus, as is visible in FIG. 3, when cable 32 is tensioned, tongue 9' to which it is linked is deformed by extending, and lowers itself on the other tongue 9' which it brings toward the foot, not represented. Simultaneously, due to the fact that the manipulation element 31 rests on the front part 23 of cuff 3, and as soon as the pressure exerted on the foot reaches a certain value, the cuff 3 is biased so as to come closer to the shell base 1. In FIG. 4, front cuff 3 is represented in a closing position on the shell base 1 coinciding with the abutment of base 19 of the oblong slot 18 on axis 16 for a tightening value of the foot in the boot allowing precisely that vertical result that is sufficient to lower the cuff into that position.

In order to guarantee optimal protection, covering, and precision of the adjustment of the foot retention functions, front cuff 3 is made with a relative differentiation of the mechanical characteristics between its front portion 23 and rear portion 13. Indeed, the front portion 23 being designed to protect the foot which is held in the boot by means of the internal retention apparatus 30 is thus advantageously rigid and not deformable. On the other hand, regarding the rear portion 13 which envelopes the zone of the lower part of the leg and which is designed to bend with the upper 2 during the practice of skiing, and at the same time, ensuring a good hold of the position of the lower portion of the leg, it is provided to be relatively flexible at least beyond the zone of the front portion of the foot, even from where the flexion fold zone begins. It is obvious that, in this context, the rear portion 13 is capable of participating in the control of the flexion of the upper with the other constituent portions of the latter and that, especially, it is provided to be smooth so as to permit a relative sliding movement with respect to wings 12 of the rear spoiler 4.

As is illustrated on FIGS. 1–4 that have just been described, the front cuff 3 is equipped with two internal foot retention apparatuses for the one corresponding to the front of the foot, each lever 31, or manipulation element, controlling a cable 32 each linked to the same tongue 9' for both apparatuses.

Figure 5:
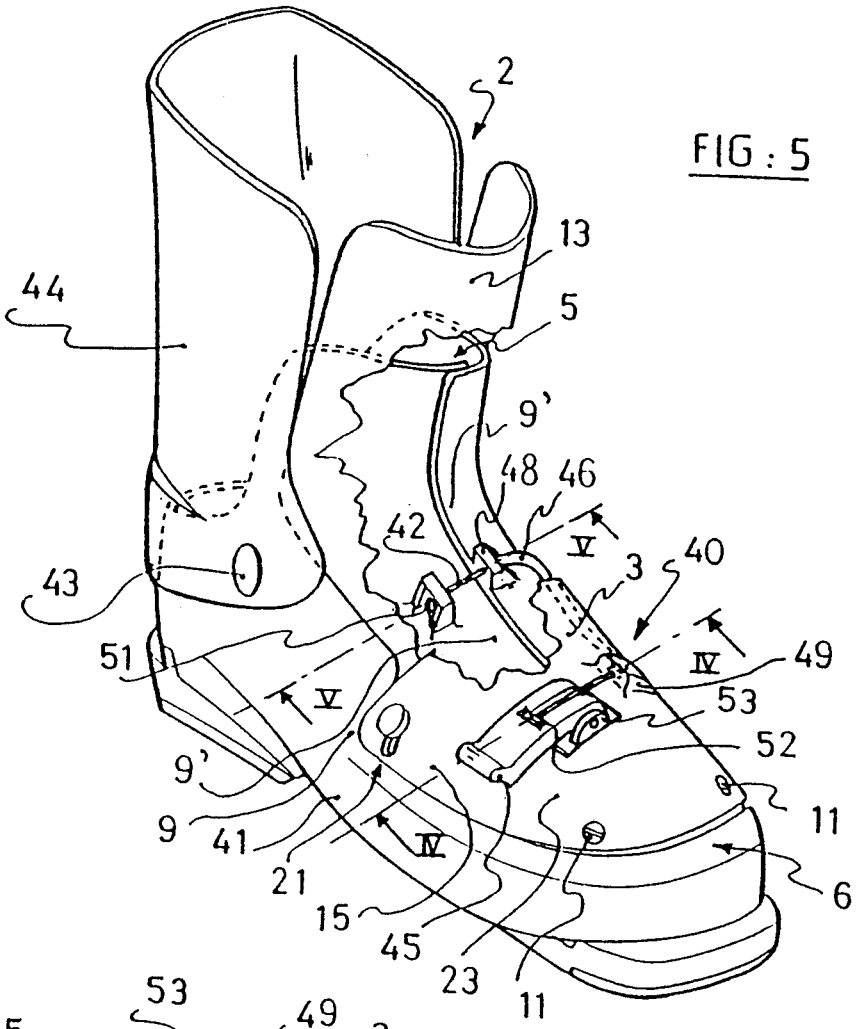
FIG. 5 is a perspective view of another ski boot provided with a front cuff similar to the invention to which is associated an internal foot retention apparatus, implementing a sheathed cable with abutments of adjustable tension.
Figure 6:
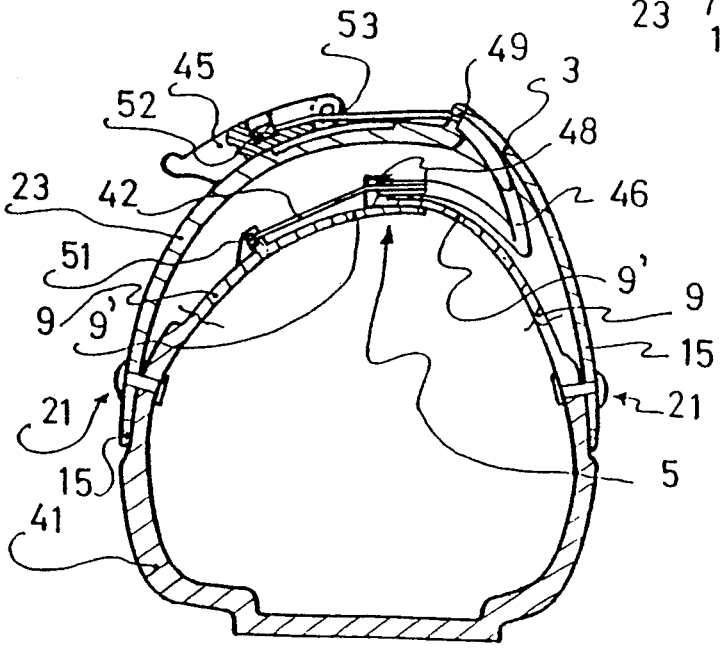
FIG. 6 is a schematic sectional view showing the position of the constitutive elements of the internal foot retention apparatus of FIG. 5, shown according to planar cross-sections IV—IV and V—V.

Other embodiments are possible within the scope of the invention. By way of example, a single manipulation element can connect two cables, or a single cable but with the return from one tongue 9' to the other, like a knot. Also, a single foot retention apparatus 40, as illustrated in FIGS. 5 and 6 which follow, can implement a single cable 42 but in a neighboring zone or further from the manipulation element 45. In this example, the ski boot is of the type comprising a rear spoiler 44 pivoting on the shell base 41 around an axis 43 located in the zone, of the malleoli, whereas the front cuff 3 is journalled, as discussed previously, around fastening points 11 located at the front 6 of the boot and is connected to the shell base 41 by a linkage and control apparatus 21 for displacement on each of the lateral extensions 15. The internal foot retention apparatus 40 that is represented implements a manipulation element 45, such as a lever pivoting on a protection 53 constituting its support, and the sheathed cable 42, the sheath 46 being the return element between the tightening zone and/or the foot retention and the manipulation element 45. To this effect, sheath 46 is provided to be flexible and incompressible and is mounted between two abutments 48 and 49, located, respectively, on one of the edges 9 of slot 5 ending at the tongue 9' and on the front cuff 3, between the two ends 51 and 52 of cable 42 linking the manipulation element 45 to one of the tongues 9' of the longitudinal slot 5. Such an embodiment ensures, for example, a foot retention in the zone of flexion and provides the manipulation element 52 on the front portion 23 of the cuff, outside the zone of flexion of the rear portion 13 of the cuff.

Figure 7:
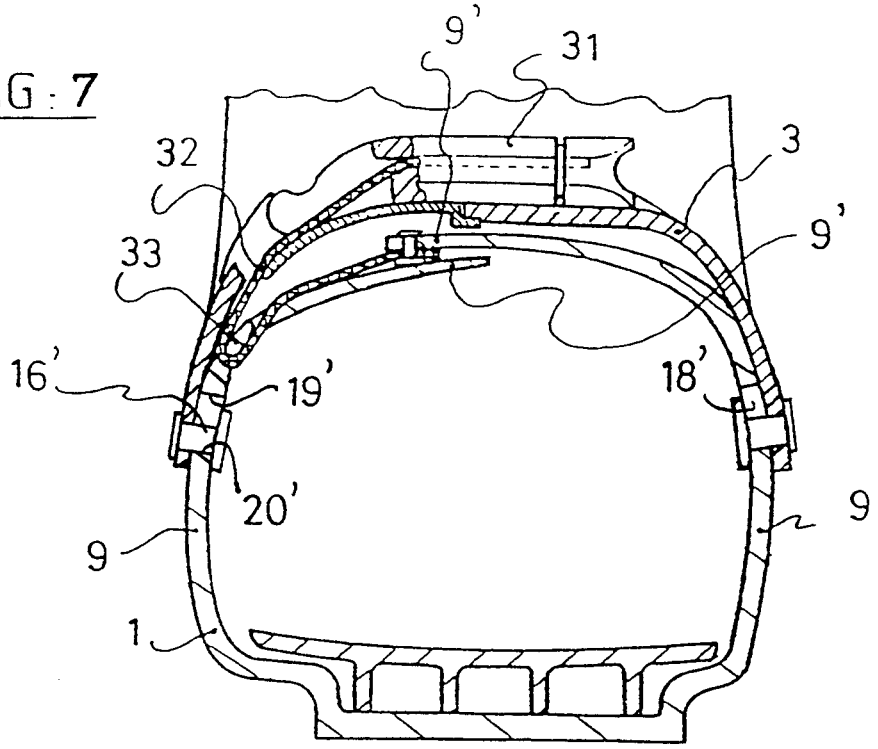
FIG. 7 is similar to FIG. 4, illustrating an alternative embodiment of the invention.

In a further alternative embodiment, as shown in FIG. 7, which is similar to FIG. 4 in showing the front cuff 3 in a closed position on the shell base 1, the slots 18' can be provided in each of the walls 9 of the shell base 1 and the pins 16' can extend from each of the lateral portions 15 of the front cuff and through a respective one of said slots. In this embodiment, the lowermost position of the front cuff is determined by means of a respective pin 16' engaging a respective lower slot end 20', and the upper end 19' of each slot 18' defines an uppermost position of the front cuff 3 by means of a respective pin 16' engaging a respective upper slot end 19'.

The disclosure of French patent application No. 90.12340, filed on Oct. 2, 1990, the priority of which is claimed under 35 U.S.C. 119, is hereby incorporated by reference thereto in its entirety.

Finally, although the invention has been described with reference of particular means, materials and embodiments, it is to be understood that the invention is not limited to the particulars disclosed and extends to all equivalents within the scope of the claims.

What is claimed is:

1. A ski boot comprising:

a rigid shell base having a front, opposite lateral walls and a front upper area with a longitudinal slot for introduction of the foot into the boot, said longitudinal slot being defined at least partially by end portions of said lateral walls;

an upper at least partially journalled on said shell base, said upper comprising a front cuff and a rear spoiler, said front cuff being pivotally mounted on said front of said shell base, said front cuff being integrally formed and having a curved channel shape that covers said front upper area of said shell base and at least partially covers said opposite lateral walls of said shell base and wherein said front cuff comprises a rigid front portion for overlying the front of the foot and a rear portion for overlying the front of the lower leg, said rear portion being more flexible than said front portion;

a connecting arrangement for connecting said front cuff to said lateral walls of said shell base, said connecting arrangement comprising:

a device for defining a predetermined vertical amplitude of movement of said front cuff including a predetermined lowermost position of said front cuff with respect to said shell base when said boot is closed upon the foot; and an internal foot retention device comprising:

at least one traction element affixed to an end portion of one of said lateral walls of said shell base; and a manipulation element positioned on said front cuff for adjusting tension in said at least one traction element.

2. A ski boot according to claim 1, wherein:

said internal foot retention device further comprises a support member on said front cuff, said manipulation element being movably mounted to said support member.

3. A ski boot according to claim 1, wherein:

said at least one traction element extends, from said end portion of said one of said lateral walls to which it is affixed, across the end portion of a second of said lateral walls and at least partially across said second of said lateral wails, and to said manipulation element.

4. A ski boot according to claim 3, wherein:

said manipulation element comprises means for adjusting tension in said at least one traction element, whereby an increase in tension in said at least one traction element causes said end portions of said lateral walls of said shell base to move in a direction for tightening on the foot and causes said front cuff to move to said lowermost position with respect to said shell base.

5. A ski boot according to claim 1, wherein:

said rigid front portion of said front cuff partially overlaps said front of said shell base, said ski boot further comprising means for linking said rigid front portion of said front cuff to said front of said shell base for permitting pivotal movement of said front cuff with respect to said front of said shell base.

6. A ski boot according to claim 1, wherein:

said front cuff further comprises a rear portion for overlying the front of the lower leg, wherein said rear spoiler comprises lateral wings, said lateral wings overlying said rear portion of said front cuff and said lateral wings, and wherein said rear portion of said front cuff comprises a closing collar of said upper for surrounding the lower leg.

7. A ski boot according to claim 1, wherein:

said manipulation element comprises means for increasing tension in said at least one traction element while said front cuff is maintained in said predetermined lowermost portion.

8. A ski boot comprising:

a rigid shell base having a front, opposite lateral walls and a front upper area with a longitudinal slot for introduction of the foot into the boot, said longitudinal slot being defined at least partially by end portions of said lateral walls;

an upper at least partially journalled on said shell base, said upper comprising a front cuff and a rear spoiler, said front cuff being pivotally mounted on said front of said shell base, said front cuff being integrally formed and having a curved channel shape that covers said front upper area of said shell base and at least partially covers said opposite lateral walls of said shell base, wherein said front cuff comprises opposite lower lateral portions and said device for defining a predetermined vertical amplitude of movement of said front cuff comprises a respective slot in each of said opposite lower lateral portions of said front cuff and a respective pin extending from each of said opposite lateral walls of said shell base through a respective one of said slots;

a connecting arrangement for connecting said front cuff to said lateral walls of said shell base, said connecting arrangement comprising:

a device for defining a predetermined vertical amplitude of movement of said front cuff including a predetermined lowermost position of said front cuff with respect to said shell base when said boot is closed upon the foot; and an internal foot retention device comprising:

at least one traction element affixed to an end portion of one of said lateral walls of said shell base; and a manipulation element positioned on said front cuff for adjusting tension in said at least one traction element.

9. A ski boot according to claim 8, wherein:

each of said slots includes a lower end and an upper end, wherein said upper end of each slot defines said lowermost position of said front cuff by means of a respective pin engaging a respective upper slot end, and wherein said lower end of each slot defines an uppermost position of said front cuff by means of a respective pin engaging a respective lower slot end.

10. A ski boot according to claim 8, further comprising:

a head on each of said pins for retaining said lower lateral portions of said front cuff against movement away from said shell base.

11. A ski boot according to claim 8, wherein:

said internal foot retention device further comprises a support member on said front cuff, said manipulation element being movably mounted to said support member.

12. A ski boot according to claim 8, wherein:

said at least one traction element extends, from said end portion of said one of said lateral walls to which it is affixed, across the end portion of a second of said lateral walls and at least partially across said second of said lateral wails, and to said manipulation element.

13. A ski boot according to claim 8, wherein:

said front cuff further comprises a rear portion for overlying the front of the lower leg, wherein said rear spoiler comprises lateral wings, said lateral wings overlying said rear portion of said front cuff and said lateral wings, and wherein said rear portion of said front cuff comprises a closing collar of said upper for surrounding the lower leg.

14. A ski boot according to claim 8, wherein:

said manipulation element comprises means for increasing tension in said at least one traction element while said front cuff is maintained in said predetermined lowermost portion.

15. A ski boot comprising:

a rigid shell base having a front, opposite lateral walls and a front upper area with a longitudinal slot for introduction of the foot into the boot, said longitudinal slot being defined at least partially by end portions of said lateral walls;

an upper at least partially journalled on said shell base, said upper comprising a front cuff and a rear spoiler, said front cuff being pivotally mounted on said front of said shell base, said front cuff being integrally formed and having a curved channel shape that covers said front upper area of said shell base and at least partially covers said opposite lateral walls of said shell base, wherein said front cuff comprises opposite lower lateral portions and said device for defining a predetermined vertical amplitude of movement of said front cuff comprises a respective slot in each of said opposite lateral walls of said shell base and a respective pin extending from each of said opposite lower lateral portions of said front cuff through a respective one of said slots;

a connecting arrangement for connecting said front cuff to said lateral walls of said shell base, said connecting arrangement comprising:

a device for defining a predetermined vertical amplitude of movement of said front cuff including a predetermined lowermost position of said front cuff with respect to said shell base when said boot is closed upon the foot; and an internal foot retention device comprising:

at least one traction element affixed to an end portion of one of said lateral walls of said shell base; and a manipulation element positioned on said front cuff for adjusting tension in said at least one traction element.

16. A ski boot according to claim 15, wherein:

each of said slots includes a lower end and an upper end, wherein said upper end of each slot defines said lowermost position of said front cuff by means of a respective pin engaging a respective upper slot end, and wherein said upper end of each slot defines an uppermost position of said front cuff by means of a respective pin engaging a respective lower slot end.

17. A ski boot according to claim 15, further comprising:

a head on each of said pins for retaining said lower lateral portions of said front cuff against movement away from said shell base.

18. A ski boot according to claim 15, wherein:

said internal foot retention device further comprises a support member on said front cuff, said manipulation element being movably mounted to said support member.

19. A ski boot according to claim 15, wherein:

said at least one traction element extends, from said end portion of said one of said lateral walls to which it is affixed, across the end portion of a second of said lateral walls and at least partially across said second of said lateral wails, and to said manipulation element.

20. A ski boot according to claim 15, wherein:

said front cuff further comprises a rear portion for overlying the front of the lower leg, wherein said rear spoiler comprises lateral wings, said lateral wings overlying said rear portion of said front cuff and said lateral wings, and wherein said rear portion of said front cuff comprises a closing collar of said upper for surrounding the lower leg.

21. A ski boot according to claim 15, wherein:

said manipulation element comprises means for increasing tension in said at least one traction element while said front cuff is maintained in said predetermined lowermost position.

22. A ski boot comprising:

a rigid shell base having a front, opposite lateral walls and a front upper area with a longitudinal slot for introduction of the foot into the boot, said longitudinal slot being defined at least partially by end portions of said lateral walls;

an upper at least partially journalled on said shell base, said upper comprising a front cuff and a rear spoiler, said front cuff being pivotally mounted on said front of said shell base, said front cuff being integrally formed and having a curved channel shape that covers said front upper area of said shell base and at least partially covers said opposite lateral walls of said shell base;

a connecting arrangement for connecting said front cuff to said lateral walls of said shell base, said connecting arrangement comprising:

a device for defining a predetermined vertical amplitude of movement of said front cuff including a predetermined lowermost position of said front cuff with respect to said shell base when said boot is closed upon the foot; and an internal foot retention device comprising:

at least one traction element affixed to an end portion of one of said lateral walls of said shell base; and a manipulation element positioned on said front cuff for adjusting tension in said at least one traction element;

wherein said at least one traction element extends, from said end portion of said one of said lateral walls to which it is affixed, across the end portion of a second of said lateral walls and at least partially across said second of said lateral walls, and to said manipulation element, said ski boot further comprising:

a first abutment on said second of said lateral walls and a second abutment on said front cuff, wherein said at least one traction element comprises a cable positioned within a flexible incompressible sheath, said flexible sheath having portions that are fixed in position between said first and second abutments.

23. A ski boot comprising:

a shell base having a front, opposite lateral walls and a front upper area with a longitudinal slot for introduction of the foot into the boot, said longitudinal slot being defined at least partially by end portions of said lateral walls;

an upper including a front cuff, said front cuff including a front portion connected to said front of said shell base, said front cuff further including a rear portion integral with said front portion of said front cuff and extending rearwardly and upwardly from said front portion to overlie a front of the lower leg;

means for connecting said front portion of said front cuff to said front of said shell base for pivoting upwardly and downwardly with respect to said shell base;

means for defining a predetermined lowermost portions of said front cuff with respect to said shell base; and means for tightening the foot in the boot while said front cuff is positioned in said predetermined lowermost position with respect to said shell base, wherein:

said means for tightening the foot in the boot comprises at least one traction element and at least one manipulation element for manual manipulation for adjusting tension in said at least one traction element, said at least one traction element being operatively connected to said end portions of said lateral walls, whereby increased tension in said at least one traction element moves at least one of said end portions of said lateral walls transversely to tighten the foot within the boot; and said at least one manipulation element is mounted on said front portion of said front cuff, wherein said at least one traction element comprises at least one cable, said at least one cable having one end connected to said at least one manipulation element, said at least one cable extending from said one end, to one of said lateral walls of said shell base, to a second of said lateral walls of said shell base;

wherein said at least one manipulation element comprises a plurality of manipulation elements and said at least one traction element comprises a plurality of traction elements.

* * * * *